US007441887B2

(12) United States Patent
Senga et al.

(10) Patent No.: US 7,441,887 B2
(45) Date of Patent: Oct. 28, 2008

(54) INK-JET PRINT SYSTEM

(75) Inventors: Takao Senga, Tokyo (JP); Kunio Kasamatsu, Tokyo (JP); Akitoshi Kajihara, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 409 days.

(21) Appl. No.: 10/525,371

(22) PCT Filed: Aug. 28, 2003

(86) PCT No.: PCT/JP03/10970

§ 371 (c)(1),
(2), (4) Date: Feb. 23, 2005

(87) PCT Pub. No.: WO2004/020207

PCT Pub. Date: Nov. 3, 2004

(65) Prior Publication Data

US 2006/0164494 A1 Jul. 27, 2006

(30) Foreign Application Priority Data

Aug. 30, 2002 (JP) ..... 2002-254462
Aug. 30, 2002 (JP) ..... 2002-254463

(51) Int. Cl.
*B41J 2/01* (2006.01)

(52) U.S. Cl. ..... 347/107; 347/19

(58) Field of Classification Search ..... 347/105, 347/101, 107, 104, 15, 19, 16, 14, 9, 8, 22, 347/106

See application file for complete search history.

(56) References Cited

U.S. PATENT DOCUMENTS 6,255,665 B1 * 7/2001 Elgee et al. ..... 250/559.4

(Continued)

FOREIGN PATENT DOCUMENTS

EP 884195 * 12/1998

(Continued)

*Primary Examiner*—Manish S Shah
(74) *Attorney, Agent, or Firm*—Kratz, Quintos & Hanson, LLP

(57) ABSTRACT

An object of the present invention is to provide an ink jet print system in which quality troubles (e.g. banding and ink overflow) caused by an unsuitable combination of ink and an ink jet recording medium in an ink jet recording apparatus in the case where the ink jet recording medium is an imitation, are obviated on the basis of printing control information obtained from the ink jet recording medium with an information-detecting sensor, and it is possible to prevent the employment of an ink jet recording medium which a user cannot judge to be a genuine product or an imitation. According to the present invention, an ink jet print system can be obtained in which printing information obtained from an image processor and the printing control information of the ink jet recording medium obtained from the information-detecting sensor are processed and on the basis of information of these kinds, the best image is always formed with the ink jet recording apparatus by the use of a genuine product. The printing control information of the ink jet recording medium is preferably a logo print or a cord image print. The ink jet recording medium is preferably of a rolled paper type. The system is stopped when an imitation is used which does not match with the printing control information.

18 Claims, 1 Drawing Sheet

U.S. PATENT DOCUMENTS 6,394,669 B1 5/2002 Janosky et al.

FOREIGN PATENT DOCUMENTS

| | | |
|---|---|---|
| JP | 5-224479 | 9/1993 |
| JP | 6-278288 | 10/1994 |
| JP | 7-227972 | 8/1995 |
| JP | 2000-25209 | 1/2000 |
| JP | 2000-238416 | 9/2000 |
| JP | 2001-302038 | 10/2001 |
| JP | 2002-240374 | 8/2002 |
| JP | 2003-223083 | 8/2003 |

* cited by examiner

INK-JET PRINT SYSTEM

TECHNICAL FIELD

The present invention relates to an ink jet print system, in particular, an ink jet print system which permits obviation of quality troubles caused by employment of an imitation ink jet recording medium called a pirated version which a user cannot judged to be an imitation.

In addition, the present invention relates to an ink jet print system which permits obviation of quality troubles caused by employment of an imitation ink jet recording medium called a pirated version which an ink jet print operator cannot judged to be an imitation.

In an ink jet print method, images, letters or the like are recorded by allowing fine droplets of ink to fly to adhere them to a recording medium such as paper by any of various principles in working. The ink jet print method has, for example, following characteristics: speeding up, noise reduction and multi-color printing are easy, the versatility of a recording pattern is high, and development-fixation is unnecessary. Therefore, the ink jet print method is being rapidly generalized for various purposes in apparatuses for recording various figures including kanji, color images and the like. Moreover, an image formed by a multi-color ink jet method can be obtained as a record which is by no means inferior to a multi-color print obtained by a photoengraving method and a photographic print obtained by a color photograph method. Furthermore, for uses requiring only a small number of copies produced, the ink jet recording method is adopted in various fields including the full-color image recording field because a print produced by this method is more inexpensive than a photographic print obtained by a photographic technique, and the diversification of the ink jet recording method is in progress.

Ink jet recording media and ink are also diversified. For example, as the ink jet recording media, not only those having an appearance with no gloss or low gloss, such as conventional plain paper and matte paper but also those having an appearance with a gloss similar to that of art paper, coated paper, cast-coated paper, photographic paper or the like are on the market. The diversification of structure of the ink jet recording media is also in progress as follows: the substrate of each medium is paper, a plastic film, nonwoven fabric or the like and the main component of the ink-absorbing layer of the medium is an inorganic pigment such as silica or alumina or an organic material such as poly(vinylpyrrolidone). Similarly, as the ink, various are on the market, depending on printer makers and the types of printers.

In addition, ink jet recording apparatuses of such a type that not only cut sheets but also a roll-like rolled article can be used owing to their structure are also on the market.

Furthermore, mini-laboratory type apparatuses are also on the market in order to automate and speed up ink jet printing on a large amount of an ink jet recording medium, and there are a large number of stores specializing in ink jet output. However, there is a flood of a wide variety of ink jet recording media and ink jet recording inks in the market at present, and a combination of such a medium and such an ink is limited to a specific combination, or their performance characteristics cannot be fully brought out if the medium and the ink do not well match with each other. Moreover, in the worst case, the above-mentioned quality troubles such as ink overflow, banding and the like are caused in some cases. Under such circumstances, it is very difficult to satisfy all demands of users.

In recent years, the number of sheets obtained by ink jet recording by a user has been steadily increased with a drop in the price of ink jet recoding media and the diversification of prints. Therefore, the user receives a considerable number of sheets of ink jet recording media of various types all at once from a store specializing in ink jet output. Ink jet recording media have been relatively expensive, have been of a few kinds and have been received in a small number all at once by a user. Therefore, there have been relatively few problems even if the needs of the user are not satisfied. In addition, in the case of individual use of a generally used inexpensive ink jet printer, there has been no particular problem when an ink jet recording media recommended by a maker of the ink jet printer and an exclusive ink jet recording ink are used.

However, there has been a growing demand for output in which the kind of an ink jet recoding medium used is changed to various types, depending on the increase of the number of sheets obtained by printing per user and a desired printed image. When a recorded matter is produced in a large amount and at a high speed by using an ink jet recording medium, the optimization of the ink jet recording medium and ink jet recording ink becomes necessary for satisfying the needs of the user.

Since the performance characteristics of personal computers have been greatly improved in the past few years, objects which have been expressible only by photography or with a printer have become expressible with an ink jet printer for A4 size or A3 size. Although large ink jet printers are fundamentally the same as the ink jet printer for A4 size or A3 size, they permit printing in a larger size (900-mm-wide rolled paper or 1200-mm-wide rolled paper is used) and make it possible to print a complicated object with a large data size composed of a combination of letters, illustrations, photographs and the like, in exacter colors. Since the performance characteristics of the large ink jet printers have been improved in the past few years, a revolution has been started in the advertisement world and the printing world. It has become possible to produce a small lot of posters, directional signs or advertising signs rapidly and beautifully at a low cost by printing digital data directly on a practical ink jet recording medium (for example, paper, cloth, poly(vinyl chloride) sheet•yupo paper with tack, a film, tarpaulin, or semiopaque•transparent film for decorative illumination) in a practical size.

The large ink jet printers have the following advantages. They include those for seal sticker•automobile and those for the windows of store•building. Printing on a poly(vinyl chloride) film with tack or yupo paper with tack is conducted and laminating treatment was carried out, followed by cutting of the periphery. A print with a relatively simple content (for example, letters showing the name of company for an automobile, or a logo mark of three or four colors) can be produced by cutting sheet and can be neatly finished. There is POP for large posters, poster panel•exhibition, entertainment•event, and promotion of sale. Employment of dye ink is sufficient because vivid color development is necessary for attraction and the period of service is relatively short.

A user brings image data into a store specializing in ink jet output and requests output using a desired ink jet recording medium. Needless to say, the user selects a store specializing in ink jet output which carries out beautiful output at a low price and accurately adjusts color matching. In the case of digital printing, accurate output of colors is difficult, so that a disastrous result of printing is often obtained if the data brought into by the user is outputted as it is. Therefore, the store specializing in ink jet output judges the opinion and purpose of use of the user from the standpoint of an expert and selects the best ink for the ink jet recording medium. Special care is necessary when the print is used in an outdoor signboard, an electrically illuminated signboard or the like. When the user makes a request to an operator having no expert experience and knowledge about signboards in the store specializing in ink jet output, a disastrous result is obtained.

In addition, the store specializing in ink jet output has to process the data quickly. A print can be produced at a low cost because only printing of the digital data is conducted. When the data are once obtained, they are unnecessary in the second and subsequent operations. The store can produce a small lot of posters, i.e., about 200 or less posters at a lower cost as compared with printing with a printing machine because the store can omit steps such as photoengraving. An article with a relatively simple content (for example, a signboard full of letters) can be produced at a lower cost by handwriting or cutting sheet. In the case of an article with a complicated content involving a photograph and a gradation, ink jet is more advantageous.

In addition, the ink jet has various uses as follows. For the decoration of a room, the ink jet is employed in the case of original posters, calendars, photographic panels, tapestries and the like. When the ink jet is utilized by an operator for producing a signboard, it is employed in the case of outdoor•indoor signboards, guide boards for entertainment•event, signboards for store, electrically illuminated signboards, rooftop advertising signboards, information maps, banners for advertisement on wall surface, and the like. Moreover, the ink jet permits beautiful finishing within a shorter period for delivery as compared with a conventional means for producing a signboard (painting or cutting sheet). Owing to the spread of signboards produced by the ink jet, the contents of advertising media are desired to be more complicated and higher-degree contents involving a photograph and a gradation, as compared with conventional simple contents. As to the utilization of stores specializing in ink jet output, there is a growing demand for the stores because even a small lot of prints can be produced in a short period for delivery and at a low cost in these stores without intermediate steps such as photoengraving.

In selecting an ink jet recording medium, it is safe to make a determination after consulting a store specializing in ink jet output. In the case of articles used for a long period of time or in the open, such as advertising products and signboards, their weather resistance, water resistance and removability come into question. Therefore, it is safe to ask a store specializing in ink jet output and having such knowledge, to make a determination. Working (attachment) is also an important problem. Because of properties of a print produced by the ink jet, attachment on the spot is unavoidable in some cases. An ink jet recording medium has to be selected which matches with a material for a surface to which the print is attached and the shape and unevenness of the surface. In the case of an output product with a large area (for example, a product obtained by output in portions (several meters each)) or an article to be attached to a widow surface (air bubbles, dust and the like are seen from the backside), the attachment is impossible unless a request for it is made to an expert worker.

Large ink jet printers have been being rapidly spread in recent years because they are smaller than conventional printing machines and the like and give superior images. However, even in such a large ink jet printer, when printing is conducted on different kinds of printing papers by the same method, the manners of running and drying of ink vary depending on the printing papers, so that the colors and density of images formed are not uniform, resulting in output of images different from the original image data.

That is, in the ink jet printer, dots are formed by discharging fine ink droplets from an ink jet head to strike the droplets against an ink jet recording medium. However, since the ink droplets run, spread and dry after the striking against the ink jet recording medium, the size of a dot formed by one of the ink droplets varies depending on the ease of blotting of the ink jet recording medium (for example, a coated-paper type ink jet recording medium hardly blots but a plain-paper type ink jet recording medium blots easily). In practice, the variation appears as the difference of the density to human eyes. In addition, a color change is caused in some cases, depending on printing paper.

In order to obtain a good image in ink jet recording, the best matching of ink with an ink jet recording medium is necessary. That is, it is necessary to prepare the best recording medium for predetermined printer and ink. This recording medium is generally called exclusive paper. In the case of a commercial printer for domestic use, there is a step of selecting printing paper used and printing mode on the screen of a computer at the time of printing. According to this selection, the computer controls the discharge of ink so that an image most suitable for a recording medium (in general, printing paper) set in the printer can be obtained. When a wrong selection of printing paper is made, serious problems such as ink overflow and the banding described hereinafter are often caused. Particularly when a beautiful photograph is desired, the wrong selection of printing paper results in output of a print disagreeable to see. That is, when the combination of ink and the recording medium is wrong, no good image is obtained as a result.

In this case, the printing mode includes, for example, a draft mode, a normal mode, a high-grade mode and a highest-grade mode. These modes are different in the number of relative scanning operations of a print head, i.e., the number of its passes, per dot line of the recording medium. For example, a dot line is formed by one pass in the case of the draft mode, two passes in the case of the normal mode, four passes in the case of the high-grade mode or eight passes in the case of the highest-grade mode. The number of nozzles for forming a dot line is increased with an increase of the number of passes. As a result, density non-uniformity caused by the non-uniformity of the amount of ink discharged from each nozzle is reduced and spaces (banding) between dots or lines become inconspicuous, but the amount of ink discharged per unit area is increased.

In order to prevent this increase, attempts have been made to make it possible to output the same image even by the use of different kinds of ink jet recording media by changing an image processing method, depending on the kinds of the ink jet recording media, ink and the like.

For this purpose, it is, of course, necessary that the ink jet printer should recognize the kind of ink jet recording medium set in the apparatus. As to a method for the recognition, it has been necessary for an ink jet print operator to determine the kind of the ink jet recording medium by means of the printer driver and operating panel on the computer.

However, the ink jet print operator cannot judge the ink jet recording medium to be either a genuine one or a general-purpose one by visual observation of only the recording medium. Moreover, the circulation of inexpensive and inferior imitations called pirated versions has begun on the market in recent years, so that damage from printing troubles is increasing. Since the ink jet print operator cannot judge the ink jet recording medium as described above, the operator cannot make a judgment in some cases without actual printing. What is worse, there is the following problem. If the ink jet recording medium is found to be an imitation from the beginning, the damage is slight. However, if an imitation ink jet recording medium mixes with a genuine one, not only the printing cost due to the ink jet recording medium and ink but also the separation and recovery cost are increased when a defective print is found after ink jet printing of a large amount the above recording media. In addition, in the worst case, the maintenance of the whole ink jet print system becomes necessary owing to frequent troubles such as ink overflow, resulting in an enormous loss to an ink jet print trader. This is a serious problem.

As prior arts, there are those in which whether an ink cartridge set in a printer is a regular one or not is automatically judged (see, for example, JP-A-7-227972 (column 0003)). There are also prior arts that provide a recording sheet having the following various performance characteristics: it is stable in detectability, its mark portion for detection is not so conspicuous to be an eyesore, and a space for setting a detector in a printer can be reduced (see, for example, JP-A-2000-238416 (column 0052)). In addition, there are print output apparatuses which make it possible to judge the adaptability of a replaceable part with high precision by utilizing the existing structure of the apparatus to maximum without adding a means for possessing information to the replaceable part (see, for example, JP-A-2003-223083 (column 0015)).

DISCLOSURE OF THE INVENTION

However, the above-mentioned determination of the kind of an ink jet recording medium by an ink jet print operator has to be carried out whenever the kind of an ink jet recording medium is changed. Thus, the determination has been troublesome also to the ink jet print operator. In addition, if the determination is wrong, the print quality is also influenced thereby, so that no image can be obtained by utilizing the optimum performance of the recording medium.

Moreover, from the appearance of the ink jet recording medium, the ink jet print operator cannot judge what an image quality can be attained. In particular, in recent years, imitation ink jet recording media called pirated versions, which have a bad quality and an appearance similar to that of a genuine ink jet recording medium most suitable for the ink jet print system, have appeared on the market, so that quality troubles such as ink overflow and banding are often caused. This is becoming a problem.

Therefore, an object of the present invention is to use automatically only a genuine ink jet recording medium which makes it possible to select the optimum ink, depending on the kind of the ink jet recording medium, and to obviate printing troubles caused by the employment of an inferior imitation called a pirated version. As a result, the object is to provide a ink jet print system which can always provide a user with images of the highest quality by the optimization of the ink jet recording medium, ink and the like.

Another object of the present invention is to provide an ink jet print system that markedly reduces a loss caused by the occurrence of printing troubles (e.g. banding and ink overflow) caused by a wrong combination of ink and an ink jet recording medium in an ink jet recording apparatus which is due to the employment of an imitation ink jet recording medium called a pirated version. In addition, the object is to provide an ink jet print system which makes it possible to obviate printing troubles caused by a flood of imitation ink jet recording media, which an ink jet print operator cannot judge, on the market, and to reduce greatly a loss due to accidents by controlling the ink jet recording medium, the ink and the like.

The present invention relates to an ink jet print system in which an ink jet recording medium previously having printing control information is continuously driven with a conveying apparatus, and print data is continuously processed with an ink jet recording apparatus set in the middle of a conveyance pathway, to output a printed image.

The printing control information according to the present invention preferably involves information of various kinds about the kind of ink most suitable for the ink jet recording medium, the kind of a substrate and the kind of an ink-receiving layer(s), and at least one item of information for controlling a conveying and driving apparatus, an ink jet recording apparatus, and a discharging apparatus for ink nozzles in the recording apparatus, a cutter apparatus, a tray apparatus and the like, which information is for controlling a series of the apparatuses of the ink jet print system on the basis of the above-mentioned information of various kinds.

The present invention is itemized as in the following list.

(1) An ink jet print system in which an ink jet recording medium previously having printing control information is continuously driven with a conveying apparatus, and print data is continuously processed with an ink jet recording apparatus set in the middle of a conveyance pathway, to output a printed image.

(2) An ink jet print system according to (1), wherein the printing control information involves information of various kinds about the kind of ink most suitable for the ink jet recording medium, the kind of a substrate and the kind of an ink-receiving layer(s), and at least one item of information for controlling a conveying and driving apparatus, an ink jet recording apparatus, and a discharging apparatus for ink nozzles in the recording apparatus, a cutter apparatus, a tray apparatus and the like, which information is for controlling a series of the apparatuses of the ink jet print system on the basis of the above-mentioned information of various kinds.

(3) An ink jet print system according to (1) or (2), wherein an information-detecting sensor is located short of said ink jet recording apparatus in the conveyance pathway, and the driving apparatus stops when the printing control information is not detected in said ink jet recording medium.

(4) An ink jet print system according to (1) or (2), wherein an information-detecting sensor is located short of said ink jet recording apparatus in the conveyance pathway, and an image different from that based on image data is outputted so as not to permit formation of a desired image, without interlocking said ink jet recording apparatus with the conveying apparatus, when the printing control information is not detected in said ink jet recording medium.

(5) An ink jet print system according to (1) or (2), wherein an information-detecting sensor is located short of said ink jet recording apparatus in the conveyance pathway, and the discharge of ink in said ink jet recording apparatus is stopped to output no printed image when the printing control information is not detected in said ink jet recording medium.

(6) An ink jet print system according to (1) or (2), wherein an information-detecting sensor is located short of said ink jet recording apparatus in the conveyance pathway; information related to the printing control information of said ink jet recording medium is stored in the system as database information and compared with the printing control information of said ink jet recording medium obtained from the information-detecting sensor; and said ink jet recording medium is cut to a predetermined length with a cutter apparatus to conduct finishing when the printing control information of said ink jet recording medium agrees with the database information in the system.

(7) An ink jet print system according to any one of (1) to (3), wherein information related to the printing control information of said ink jet recording medium is stored in the system as database information and compared with the printing control information of said ink jet recording medium obtained from the information-detecting sensor, and the conveying and driving apparatus stops when the printing control information does not agree with the database information.

(8) An ink jet print system according to any one of (1), (2) and (4), wherein information related to the printing control information of said ink jet recording medium is stored in the system as database information and compared with the printing control information of said ink jet recording medium obtained from said information-detecting sensor, and an image different from that based on image data is outputted so as not to permit formation of a desired image, without interlocking said ink jet recording apparatus with the conveying apparatus, when the printing control information does not agree with the database information.

(9) An ink jet print system according to any one of (1), (2) and (5), wherein information related to the printing control information of said ink jet recording medium is stored in the system as database information and compared with the printing control information of said ink jet recording medium obtained from the information-detecting sensor, and the discharge of ink in the ink jet recording apparatus is stopped to output no printed image when the printing control information does not agree with the database information.

(10) An ink jet print system according to any one of (1) to (9), wherein said ink jet recording medium is a rolled paper having a core.

(11) An ink jet print system according to any one of (1), (2), (5) and (9), wherein the discharge of ink in said ink jet recording apparatus is stopped and the conveying apparatus is driven to recover the ink jet recording medium having no printed image, with a roll-recovering apparatus.

(12) An ink jet print system according to any one of (1), (2), (4) and (8), wherein the discharge of ink in said ink jet recording apparatus is stopped and the conveying apparatus is driven to recover the ink jet recording medium having an outputted image different from that based on image data, with a roll-recovering apparatus.

(13) An ink jet print system according to (1) or (2), wherein said ink jet recording medium is separated with a roll-recovering apparatus.

(14) An ink jet print system according to (1) or (2), wherein said ink jet recording medium is cut with a cutter and then separated with the tray apparatus, instead of using a roll-recovering apparatus.

(15) An ink jet print system according to any one of (1) to (10), wherein said printing control information is provided on the side reverse to the side of said ink jet recording medium on which ink jet recording is to be conducted.

(16) An ink jet print system according to any one of (1) to (10), wherein said printing control information of said ink jet recording medium is detected with the information-detecting sensor by means of at least one light selected from visible light, near infrared rays and fluorescence.

(17) An ink jet print system according to any one of (1) to (10), wherein at least one of a logo print and code information is selected as said printing control information of said ink jet recording medium and is detected with the information-detecting sensor.

(18) An ink jet print system according to any one of (1) to (10), wherein after the impartment of said printing control information to said ink jet recording medium, the surface on which the impartment has been carried out is subjected to at least one treatment selected from coating of the surface with a resin by extrusion coating and attachment of a resin film to the surface.

(19) An ink jet print system according to any one of (1), (2), (4) and (8), wherein the amount of ink discharged from the ink nozzles of the ink jet recording apparatus is smaller than the optimum amount by 10% or more, or the speed of conveyance of the ink jet recording medium in the ink jet recording apparatus is higher than the optimum speed by 10% or more.

Figure 1:
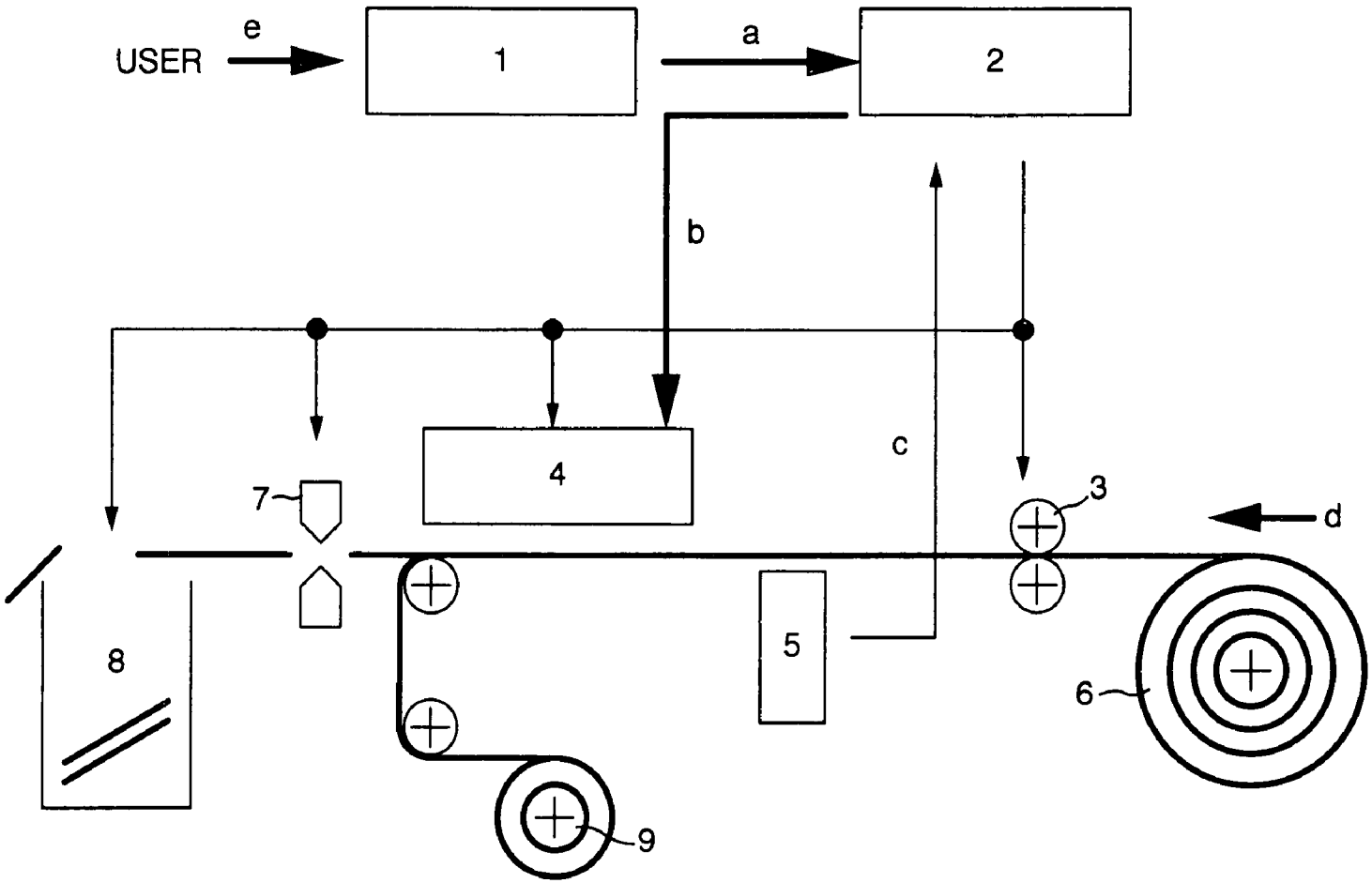
FIG. 1 is a block diagram showing the whole structure of a print system according to an embodiment of the present invention. The reference numerals denote the following.

1: image processor,
2: processing-for-printing apparatus,
3: conveying and driving apparatus,
4: ink jet recording apparatus,
5: information-detecting sensor,
6: ink jet recording medium,
7: cutter apparatus,
8: tray apparatus,
9: roll-recovering apparatus,
a: printing information,
b: output information,
c: printing control information,
d: direction of scanning,
e: image data.

MODE FOR CARRYING OUT THE INVENTION

A first embodiment of the present invention is an ink jet print system in which an ink jet recording medium previously having printing control information is continuously driven with a conveying apparatus, and print data is continuously processed with an ink jet recording apparatus set in the middle of a conveyance pathway, to output a printed image, and in which an information-detecting sensor is located short of said ink jet recording apparatus in the conveyance pathway, and the conveying and driving apparatus stops when the printing control information is not detected in said ink jet recording medium.

In addition, the first embodiment is preferably an ink jet print system in which information related to the printing control information of said ink jet recording medium is stored in the system as database information and compared with the printing control information of said ink jet recording medium obtained from the information-detecting sensor, and the conveying and driving apparatus stops when the printing control information does not agree with the database information.

A second embodiment of the present invention is an ink jet print system in which an ink jet recording medium previously having printing control information is continuously driven with a conveying apparatus, and print data is continuously processed with an ink jet recording apparatus set in the middle of a conveyance pathway, to output a printed image, and in which an information-detecting sensor is located short of said ink jet recording apparatus in the conveyance pathway, and an image different from that based on image data is outputted so as not to permit formation of a desired image, without interlocking said ink jet recording apparatus with the conveying apparatus, when the printing control information is not detected in said ink jet recording medium.

In addition, the second embodiment is an ink jet print system in which information related to the printing control information of said ink jet recording medium is stored in the system as database information and compared with the printing control information of said ink jet recording medium obtained from said information-detecting sensor, and an image different from that based on image data is outputted so as not to permit formation of a desired image, without interlocking said ink jet recording apparatus with the conveying apparatus, when the printing control information does not agree with the database information.

A third embodiment of the present invention is an ink jet print system in which an ink jet recording medium previously having printing control information is continuously driven with a conveying apparatus, and print data is continuously processed with an ink jet recording apparatus set in the middle of a conveyance pathway, to output a printed image, and in which an information-detecting sensor is located short of said ink jet recording apparatus in the conveyance pathway, and the discharge of ink in said ink jet recording apparatus is stopped to output no printed image when the printing control information is not detected in said ink jet recording medium.

In addition, the third embodiment is a ink jet print system in which information related to the printing control information of said ink jet recording medium is stored in the system as database information and compared with the printing control information of said ink jet recording medium obtained from the information-detecting sensor, and the discharge of ink in said ink jet recording apparatus is stopped to output no printed image when the printing control information does not agree with the database information.

A fourth embodiment of the present invention is an ink jet print system in which an ink jet recording medium previously having printing control information is continuously driven with a conveying apparatus, and print data is continuously processed with an ink jet recording apparatus set in the middle of a conveyance pathway, to output a printed image, and in which an information-detecting sensor is located short of said ink jet recording apparatus in the conveyance pathway; information related to the printing control information of said ink jet recording medium is stored in the system as database information and compared with the printing control information of said ink jet recording medium obtained from the information-detecting sensor; and said ink jet recording medium is cut to a predetermined length with a cutter apparatus to conduct finishing when the printing control information of the ink jet recording medium agrees with the database information in the system.

In the ink jet print system of the present invention, said ink jet recording medium is preferably a rolled paper having a core.

In the ink jet print system of the present invention, when the discharge of ink in said ink jet recording apparatus is stopped, the conveying apparatus is preferably driven to recover the ink jet recording medium in an unprinted state with a roll-recovering apparatus, or said ink jet recording medium may be cut with a cutter and then separated with the tray apparatus, instead of using the roll-recovering apparatus.

It is necessary to print printing control information on said ink jet recording medium used in the ink jet print system of the present invention. Said printing control information is preferably provided on the side reverse to the side of said ink jet recording medium on which ink jet recording is to be conducted. Said printing control information of said ink jet recording medium is preferably detected by means of visible light, near infrared rays or fluorescence. In addition, said printing control information of said ink jet recording medium is very preferably a logo print or code information.

The ink jet print system of the present invention preferably stops when said printing control information is not detected by said detecting apparatus, or when said printing control information inputted from said detecting apparatus does not agree with output information inputted into said processing-for-printing apparatus.

The ink jet recording medium used in the ink jet print system of the present invention is preferably treated as follows: after the impartment of said printing control information, the surface on which the impartment has been carried out is coated with a resin by extrusion coating, or a resin film is attached to this surface.

In addition, a command to control printing included in said printing control information in the present invention can prevent the interlock of the optimum amount of ink discharged from ink nozzles with the speed of conveyance of the ink jet recording medium in the ink jet recording apparatus. Preferably, said command to control reduces the amount of ink discharged from the ink nozzles of the ink jet recording apparatus by 10% or more as compared with the optimum amount, or increases the speed of conveyance of the ink jet recording medium in the ink jet recording apparatus by 10% or more as compared with the optimum speed, whereby an image is formed on the ink jet recording medium.

According to the present invention, a distinction can be made between an imitation called a pirated version which cannot exhibit the best performance in the formation of a printed image and a genuine ink jet recording medium which can exhibit the best performance in the formation of a printed image, and an economic loss due to unsatisfactory printing is markedly reduced. Therefore, impressive effects can be obtained which increase the economical benefit greatly.

Furthermore, according to the ink jet print system of the present invention, print troubles can be prevented as follows even if an ink jet print operator uses an unadaptable ink jet recording medium such as an imitation because the operator cannot judge it to be unadaptable: the conveying apparatus itself stops, or an image different from that based on image data is outputted so as not to give a desired image, or the ink jet recording medium is recovered without printing thereon. Owing to the prevention, the print troubles are obviated and moreover, the following advantages can be obtained: the burden on the ink jet print operator is lessened, a printed image on an ink jet recording medium can be outputted by sufficient exhibition of the best performance characteristics of the recording medium, and excellent working efficiency and economical benefit can be attained.

BEST MODE FOR CARRYING OUT THE INVENTION

The best mode for carrying out the present invention is explained below in detail.

At first, a general embodiment is explained in which the ink jet print system of the present invention is used. A user brings digital data prepared with a personal computer or the like into a store specializing in ink jet print, in order to output a desired printed image onto an ink jet recording medium by printing. Usually, the digital data are converted into print data for an ink jet recording apparatus with an image processor so that the optimum image output result can be obtained with respect to the ink jet recording medium, ink and the like. The print data are sent to the ink jet recording apparatus to cause the discharge of ink in ink tanks through nozzles and the formation of a desired image.

In the ink jet print system of the present invention, a series of the apparatuses of said system can be controlled on the basis of the printing control information of an ink jet recording medium. The system comprises, for example, a conveying and driving apparatus for feeding the ink jet recording medium continuously to a conveyance pathway to drive the same; an ink jet recording apparatus capable of controlling nozzles for various inks to control the amounts of the inks discharged; a cutter apparatus for cutting a printed product of the ink jet recording medium to a predetermined length; and a tray apparatus for separation and recovery after the cutting with the cutter apparatus. The system controls them synthetically.

The printing control information in the present invention is information for attaining the best matching of the ink jet recording medium with an ink jet recording ink, and this information is reflected in the ink jet print system.

That is, the printing control information includes information of various kinds regarding, for example, the kind of ink most suitable for the ink jet recording medium (selected from dyes, pigments, penetrants and the like), the kind of a substrate (selected from pulp, fillers, strength agents, sizing agents, fluorescent dyes, color dyes and the like) and the kind of an ink-receiving layer(s) (selected from pigments, binders, dye fixing agents and the like). Moreover, the printing control information has to include at least one item of information for synthetically controlling the conveying and driving apparatus, the ink jet recording apparatus, a discharging apparatus for the ink nozzles in the ink jet recording apparatus, the cutter apparatus, the tray apparatus and the like, which information is for controlling a series of the apparatuses of the ink jet print system on the basis of the above-mentioned information of various kinds.

In addition, if necessary, the traceability of the product can be imparted by incorporation of information on an order for the product, lots of the products, product number and the like. It is preferable to register a recognizable image detected with an information-detecting sensor, previously in the system to store the same as database information.

In the ink jet print system of the present invention, the image output of the ink jet print system is controlled by processing print data outputted from the image processor and the printing control information detected in the ink jet recording medium having this information with the information-detecting sensor. This system optimizes ink jet recording ink and the ink jet recording medium on the basis of the printing control information recorded in the ink jet recording medium, to always assure the best image output. For example, there are a wide variety of products as the ink jet recording ink and the ink jet recording medium, and depending on a combination of the ink jet recording ink and the ink jet recording medium, print troubles such as banding and ink overflow are caused in some cases, or the inherent performance characteristics of the ink jet recording ink and the ink jet recording medium cannot be exhibited, so that no satisfactory printed image can be obtained.

Furthermore, in the ink jet print system of the present invention, in the case where the ink jet recording medium cannot exhibit the best performance in the system on the basis of the printing control information of the ink jet recording medium, in particular, the case where an ink jet print operator uses as a genuine product an inferior imitation ink jet recording medium which cannot be judged by its appearance, the ink jet print operator can confirm such a case immediately owing to the stop of the conveying apparatus, the stop of the discharge of ink from the ink jet recording apparatus, or the output of a changed printed image on the ink jet recording medium. Moreover, the system can carry out control automatically without operation by the ink jet print operator. Therefore, the burden on the ink jet print operator can be lessened, and the following effect can be obtained. An ink jet recording medium having such a quality trouble that no desired printed image can be obtained, merely becomes broke. Particularly in the case of a large-sized ink jet recording medium used for a purpose such as advertisement, not only its high cost but also a loss including the cost of disposal of the broke and the operation loss due to print troubles can be reduced to the utmost limit.

The ink jet print system of the present invention is obtained by integrating a series of apparatuses such as the conveying apparatus, the ink jet recording apparatus, the cutter apparatus and a tray driving apparatus, and the system makes it possible to control a series of these apparatuses on the basis of said printing control information obtained from the ink jet recording medium. The conveying apparatus comprises, for example, a conveying roll equipped with a conveying and driving device, a roll for sending out the core of a rolled paper, or a roll for adjusting the angle of wrap which itself is not driven and is for introduction into any of various apparatuses. The ink jet recording apparatus is preferably such that ink is discharged through each of jet nozzles equipped with individual ink tanks for multiple colors. The cutter apparatus is an apparatus for cutting the ink jet recording medium to a predetermined length after the formation of an image on the recording medium, and makes it possible to control the cutting on the basis of said printing control information. The apparatuses can be controlled either individually or in an interlock manner, depending on the kind of said printing control information.

The ink jet print system of the present invention is explained below in detail with reference to the drawing showing one example of the system.

A user submits digital data (image data e) obtained by photographing with a digital camera or the like for requesting ink jet print, to an ink jet print output store and requests ink jet print. An ink jet print operator who has complied with the request selects an ink jet recording medium, ink jet recording ink and the like properly, depending on the image data e the employment of which is required by the user. The ink jet print operator inputs the image data e submitted by the user into an image processor 1. The image data e inputted is converted to printing information a for printing in an ink jet recording apparatus, in the image processor 1 and then inputted into a processing-for-printing apparatus 2.

In the drawing, as the ink jet recording medium, a rolled paper type one is used.

An information-detecting sensor 5 detects a cord image on the reverse side of the ink jet recording medium 6 and sends cord image information to the processing-for-printing apparatus 2. The processing-for-printing apparatus 2 conducts information processing for printing control information c sent from the information-detecting sensor 5, by reference to and comparison with database information stored inside the processing-for-printing apparatus 2. On the basis of the printing control information c, the processing-for-printing apparatus 2 alters printing conditions so as to obviate print defects such as ink overflow and banding, and controls a conveying apparatus 3 and an ink jet recording apparatus 4 so as to obtain the optimum printed image on the ink jet recording medium. Thus, the processing-for-printing apparatus 2 makes preparation for ink jet printing output of output information b. The ink jet recording apparatus is preferably equipped with a large number of ink tanks containing various inks, respectively, and a large number of automatically replaceable printing nozzles, as supplementary apparatuses, so as to give an image most suitable for any of various ink jet recording media.

From the processing-for-printing apparatus 2, information obtained by combining the output information b with the control information c is sent to the whole system simultaneously with a signal for the start of ink jet printing output. The ink jet recording medium 6 is sent in the direction a of main scanning by sending-out of its core by a conveying apparatus 3, subjected to printing by the ink jet recording apparatus, cut to a predetermined length in a cutter apparatus 7 on the basis of the printing control information, separated in a tray apparatus 8, and then discharged.

In the drawing, the image processor 1 may be a personal computer as a typical example, and has software for preparation of printing data to be sent to the processing-for-printing apparatus 2. A mere memory for obtaining a desired printed image may be used in place of the software.

The processing-for-printing apparatus 2 is equipped with, for example, the following (not shown): a print head driving circuit, a conveying circuit, a circuit for the input and output of external data, a central arithmetical unit for controlling the whole of the processing-for-printing apparatus 2, and database information including stored information about the optimum printing conditions attained by, for example, combination of ink jet recording ink and the ink jet recording medium.

The conveying apparatus 3 comprises a paper feed roller unit, a conveying and driving portion and the like, though all of a series of devices for driving the ink jet recording medium are not shown. The conveying apparatus 3 conveys a cartridge of the ink jet recording medium 6 in the form of a rolled paper attached to a core, in the direction of scanning shown by the arrow in the drawing, on the basis of printing information from the processing-for-printing apparatus 2. As a means for the conveyance and driving, any means may be employed so long as the recording medium can be conveyed without any trouble. That is, the core may be driven, or the ink jet recording medium may be sent by holding it between rolls, or the ink jet recording medium may be cut sheets.

In the case of ink jet printing, it is important to convey the recording medium so that the conveyance may be synchronized with the discharge of ink. If the discharge and the conveyance are not synchronized with each other, no good image can be obtained.

The ink jet recording apparatus 4 comprises a print head, a print head driving device, a head maintenance device and the like, which are not shown. Ink tanks for supplying ink to the print head or various replaceable ink cartridges can be automatically set in the ink jet recording apparatus 4 so as to be freely removable.

The information-detecting sensor 5 detects the printing control information c composed of a recognizable image on the reverse side of the ink jet recording medium 6, such as a printed logo, dot cord or bar cord, takes the printing control information c in as information about the ink jet recoding medium, and sends the printing control information c to the processing-for-printing apparatus 2.

In the ink jet print system of the present invention, the data processor of the processing-for-printing apparatus 2 chooses printing conditions in the database stored information so as to permit the optimum printing on the ink jet recording medium, on the basis of the printing control information c from the information-detecting sensor 5, controls the conveying apparatus 3 and the ink jet recording apparatus 4, and processes the printing information b for printing.

The embodiment described above is an example for explaining the present invention. The present invention is not limited to the above embodiment and various changes and modifications may be made without departing from the gist of the invention. For example, the image processor 1 may be a common personal computer and need not be provided in the ink jet printer equipment described above.

Next, the control of the ink jet print system of the present invention is explained below in detail.

In the ink jet print system of the present invention, in the case where said printing control information is not detected by said information-detecting sensor, or the case where even if a genuine ink jet recording medium is used, its optimum performance cannot be exhibited because of unsuitable ink, or the case where a print trouble is caused in spite of employment of adaptable ink because of employment of an imitation ink jet recording medium such as a pirated version which is not a genuine one produced by a bona fide maker, there can be taken a measure to prevent printing on an ink jet recording medium completely, such as the stop of the conveying apparatus or the stop of the discharge of ink from the nozzles of the ink jet recording apparatus. Moreover, control can be exercised so as to prevent the formation of a desired printed image on the ink jet recording medium, by preventing interlocking of the conveying and driving apparatus and the ink jet recording apparatus with each other. When the system stops owing to the stop of the conveying and driving apparatus, the discharge of ink preferably stops. That is, in the ink jet print system of the present invention, when the ink jet recording medium is a genuine one, its optimum performance can be exhibited. Even if the ink jet recording medium is an imitation, the occurrence of quality troubles can be prevented.

Furthermore, in the ink jet print system of the present invention, when said printing control information is not detected by said information-detecting sensor, an image can be outputted without interlocking of said ink jet recording apparatus and said conveying and driving apparatus with each other in order not to permit formation of a desired image. Therefore, the printed image on the ink jet recording medium is undesired one and the ink jet print operator can easily confirm this fact. Accordingly, the ink jet operator can take a countermeasure against the ink jet recording medium or mismatching of ink immediately, so that no quality trouble is caused, resulting in a higher working efficiency. That is, at the same amount of ink discharged from the ink jet recording nozzles, an extended image is obtained when the conveyance speed of said conveying and driving apparatus is increased, while a shrunk image is obtained when the speed is reduced. On the other hand, at the same conveyance speed of said conveying and driving apparatus, the print density is decreased when the amount of ink discharged from the ink jet recording nozzles is reduced, and the print density is increased when the amount of ink discharged is increased.

For economical benefit and the avoidance of quality troubles, the conveyance speed is preferably increased and the amount of ink discharged is preferably reduced. Moreover, in the ink jet print system of the present invention, the conveyance speed and the amount of ink discharged may be individually controlled.

In the ink jet print system of the present invention, information related to the printing imparted information of said ink jet recording medium is preferably stored in a database in the processing-for-printing apparatus provided as an attachment for data processing. In said processing-for-printing apparatus, said printing control information and said print data are processed and are reflected in the ink jet print system.

As the information stored in the database, there is preferably stored, as described above, information about brands concerning the kind of a substrate and the kind of an ink-receiving layer(s) for the ink jet recording medium and information of all kinds for selecting the optimum ink as ink jet recording ink employed for said medium. In particular, for excluding an imitation, it is preferable to store as much information detectable with the information-detecting sensor as possible in the database to prevent imitation. In addition, since the ink jet recording medium is somewhat different in some cases, depending on production lot and order, the system is preferably such that feedback is given on the amount of ink discharged in the ink jet recording apparatus and the selection of ink jet recording ink in the consideration of information about the numbers for production described above.

In the ink jet print system of the present invention, it is necessary to have specific linked information about the printing control information and said database stored information, in the information processing with the processing-for-printing apparatus. When the linked information indicates the disagreement between the above two kinds of information, the conveying apparatus can be stopped. Said linked information may be previously set in constructing the ink jet print system of the present invention, or information on a novel product can be newly inputted after constructing the system. By contrast, the linked information can be properly altered, for example, by omitting information about disused brands.

In the ink jet print system of the present invention, when the printing control information does not agree with the database stored information in the information processing with the processing-for-printing apparatus, a changed image can be outputted without interlocking of the ink jet recording apparatus and the conveying and driving apparatus with each other in order not to permit formation of a desired image. Therefore, an ink jet print operator can easily confirm the mismatching through the printed image on the ink jet recording medium and hence can cope with the mismatching immediately.

In the ink jet print system of the present invention, when the printing control information obtained from the ink jet recording medium by the information-detecting sensor does not agree with the database stored information in the information processing with the processing-for-printing apparatus, the conveying and driving apparatus for conveying the ink jet recording medium can be stopped. The stop of the conveying and driving apparatus markedly reduces the conveyance of an ink jet recording medium that causes unprofitable quality troubles and inferior print, and hence this stop is very economical. When the conveying and driving apparatus is stopped, a roll-form ink jet recording medium can be returned to a feeder to be rewound, by the reversion of the conveying and driving apparatus, or can be recovered by winding-up with a winding-up and recovering device. In addition, an ink jet recording medium in a cut sheet form can be separated and recovered with the tray apparatus.

In the ink jet print system of the present invention, when said printing control information does not agree with said database stored information in the information processing with said processing-for-printing apparatus, the discharge of ink in the ink jet recording apparatus can be stopped. In this case, the conveying and driving apparatus keeps working and a roll-form ink jet recording medium is wound up in an unprinted state with a recovering apparatus, while cut sheets can be separated and recovered with the tray apparatus.

Thus, when said printing control information does not agree with said database stored information even partly, the roll or cut sheets can be separated as a defective product without printing in the ink jet recording apparatus, so that unnecessary inferior prints, printing troubles and the like are obviated, resulting in a high working efficiency. Therefore, a great economical benefit can be gained and moreover, it becomes possible to provide a print by the optimization of an ink jet recording medium and ink jet recording ink.

In the ink jet print system of the present invention, when said printing control information does not agree with said print data, an image different from that based on image data can be outputted in order not to permit formation of a desired image, by changing the amount of ink discharged in the ink jet recording apparatus. However, since it is uneconomical to print the image different from that based on the image data on the whole of the ink jet recording medium, proper adjustment can be carried out. It is preferable to print out a print sample in an amount corresponding to approximately a cut sheet and stop the conveying and driving apparatus to indicate mismatching of the ink jet recording medium to an operator. In addition, in this case, the following is preferable: after the print sample is printed out, the discharge of ink jet recording ink is stopped and the ink jet recording medium is cut into a cut sheet, and the conveying and driving apparatus is automatically stopped.

In the ink jet print system of the present invention, as said ink jet recording medium, rolled paper is preferably wound around a core and subjected to ink jet recording. Needless to say, an ink jet recording medium in a cut sheet form may also be used depending on the kind of the conveying and driving apparatus, though considering the high-speed printability and high-speed conveyability, an ink jet recording medium wound around a core in the form of a roll is preferably used because its handling is easy. In view of convenience, the ink jet recording medium wound around the core is preferably one having such a structure that the medium is stored in a cassette-like case and that an ink jet operator can easily set the medium in a delivering apparatus.

In the ink jet print system of the present invention, even when the discharge of ink in the ink jet recording apparatus is stopped, the line conveyance apparatus keeps working and the ink jet recording medium can be recovered with the winding-up device for said ink jet recording medium without being cut into cut sheets.

Moreover, in the ink jet print system of the present invention, said ink jet recording medium can be separated and recovered with the tray apparatus after cutting with the cutter apparatus, instead of recovering it with the winding-up and recovering device.

In the ink jet print system of the present invention, when the printing control information agrees with the print data in the information processing with the processing-for-printing apparatus, the ink jet recording medium can be cut to a predetermined length which makes it possible to obtain a desired printed image, with the cutter apparatus, instead of winding it up.

In the present invention, a sized-down small system comprising a group of existing apparatuses such as a commercial ink jet printer can also be constructed.

The information-detecting sensor reads the recognizable printing control information of the ink jet recording medium and sends the printing control information to the ink jet recording apparatus. The ink jet recording apparatus refers to the data base information on the basis of the printing control information sent from the information-detecting sensor and judges the ink jet recording medium on the basis of the printing control information to be a genuine product capable of exhibiting the optimum performance, or an unadaptable imitation called a pirated version. When the ink jet printing medium is a genuine product, the ink jet recording apparatus confirms the adaptability of the ink jet recording medium and ink to each other, controls the conveying apparatus and the amount of ink discharged, so as to obviate print defects such as ink overflow and banding, changes a print mode, and then conducts printing.

As the image processor, a computer as a typical example is used. The image processor has software for preparation of image data to be sent to the ink jet recording apparatus. A mere memory for obtaining a desired printed image may be used in place of the software.

The ink jet recording apparatus is equipped with a print head driving circuit, a conveying circuit, a circuit for the input and output of external data, CPU for controlling the whole of the ink jet printing apparatus, and database information recording a suitable print mode based on the combination of ink and the ink jet recording medium. The ink jet recording apparatus further comprises a print head, a print head driving device, a head maintenance device and the like. Ink tanks for supplying ink to the print head or replaceable ink cartridges can be automatically set in the ink jet recording apparatus so as to be freely removable.

The conveying apparatus comprises a roller unit for feeding ink jet recording medium, a conveying and driving portion and the like, and conveys the ink jet recording medium in the form of a rolled paper at a signal from a printing and processing circuit. As a means for the conveyance and driving, any means may be used, that is, the core of the roll may be rotated or the recording medium may be sent by holding it between rolls or the like. In the case of ink jet printing, it is important to convey the recording medium so that the conveyance may be synchronized with the discharge of ink. If the discharge and the conveyance are not synchronized with each other, no optimum image can be obtained.

The information-detecting sensor reads the printing control information of the ink jet recording medium and, for example, information about ink most suitable for the ink jet recording medium and sheet is processed in the ink jet recording apparatus.

CPU of the ink jet recording apparatus selects printing conditions most suitable for the ink jet recording medium from the database information on the basis of information from the information-detecting sensor, and conducts printing while controlling the conveying apparatus and the amount of ink discharged from the ink nozzles.

A processing procedure in CPU of the ink jet recording apparatus having the above general structure is briefly explained below. Although the printing control information previously provided in the ink jet recording medium is not particularly limited so long as it can be detected with the information-detecting sensor, preferably, an optical detecting sensor, the printing control information is preferably a code image for judgment after reading. The code image of the ink jet recording medium is detected and then compared with the database information of the processing-for-printing apparatus. When the code image agrees with the database information, printing is conducted in a proper print mode. When the code image does not agree with the database information, printing is not conducted or a changed image can be outputted.

At first, print data is sent to the ink jet recording apparatus from the image processor. When the print data is sent, the printing control information of the ink jet recording medium is detected with the conveying apparatus and the information-detecting sensor and processed with the ink jet recording apparatus. CPU of the ink jet recording apparatus compares the printing control information with that registered in the database information, and judges whether they agree with each other or not. When they agree with each other, CPU selects a proper print mode on the basis of the database information and conducts printing while controlling the conveying apparatus and the amount of ink discharged from the ink nozzles.

If it is judged by comparison that the printing control information of the ink jet recording medium does not agree with the printing control information registered in the database information stored in the ink jet recording apparatus, it is possible to stop ink jet printing and the conveyance of the ink jet recording medium and request a user to replace the ink jet recording medium.

Whether the ink jet recording medium has been replaced or not is judged. When the replacement has been carried out, the above procedure is repeated until the agreement of the printing control information.

When the replacement has not been carried out, printing is discontinued or an image different from a desired image is printed.

When the control described above is carried out, the printer system selects a print mode suitable for the ink jet recording medium without a user's worry for the selection of the print mode, so that a good image can be obtained. When there is no suitable print mode, printing is discontinued or a different image is printed. Therefore, no print defect is caused.

As the recognizable cord image, well-known ones are exemplified. There can be used, for example, bar cords, two-dimensional cords, and cords composed so as to represent "1" and "2" as binary data.

The ink jet recording medium used in the ink jet print system of the present invention has printing control information. As described above, said printing control information includes information about brands concerning the kind of a substrate and the kind of an ink-receiving layer(s) and optionally information about product order, product lot, product number and the like, and can also impart the traceability of the product. In addition, it is preferable that the print additional information to be detected by the information-detecting sensor is previously registered in the database stored information. Needless to say, said database stored information may be newly registered in order to use the ink jet print system of the present invention.

The printing control information is preferably provided on the side reverse to the side of said ink jet recording medium used in the ink jet print system of the present invention on which ink jet recording is to be conducted. When the printing control information is provided on the ink jet recording side or provided on a substrate before forming an ink jet recording layer thereon, the influence of ink during ink jet recording is serious and moreover, the detection sensitivity of the information-detecting sensor is decreased. Therefore, the printing control information is preferably provided on the side reverse to the ink jet recording side.

Said printing control information of the ink jet recording medium used in the ink jet print system of the present invention is preferably detected by means of visible light. When visible light is used, this operation can be carried out by means of indoor light without attaching special equipment to the information-detecting sensor. Even an ink jet print operator can easily judge by quick visual observation whether the ink jet recording medium can be used in the present invention or not. Therefore, the operator can make this judgment at least before ink jet printing, so that quality troubles can be reduced. However, a wicked trader can produce an inferior imitation similar to a genuine product. Accordingly, it is finally unavoidable to rely on the printing control information detected in the ink jet print system of the present invention instead of relying on the visual observation of the ink jet print operator.

Said printing control information of said ink jet recording medium used in the ink jet print system of the present invention is preferably detected by means of near infrared rays. In this case, as the information-detecting sensor, a sensor having a sufficient sensitivity to carry out the detection by means of near infrared rays is, of course, used. The merit of the employment of near infrared rays lies in the fact that a pattern printed as said print additional information cannot be visually confirmed. Therefore, the printed pattern that seems unpleasant or unnecessary to a user can be processed without observation thereof by the user.

Said printing control information of said ink jet recording medium used in the ink jet print system of the present invention preferably emits fluorescence. In this case, the printing control information has to be provided on the reverse side of the ink jet recording medium. Since the ink-receiving layer(s) of the ink jet recording medium usually contains a fluorescent brightener, the printing control information has to be provided on the side reverse to the ink-receiving layer(s) side because otherwise it cannot be detected with the information-detecting sensor. Said printing control information emits fluorescence on irradiation with ultraviolet rays, so that information can be obtained with the information-detecting sensor. The merit of the employment of fluorescence lies in the fact that a pattern printed as said print additional information cannot be visually confirmed. Therefore, the printed pattern that seems unpleasant or unnecessary to a user can be processed without observation thereof by the user.

As to said printing control information of said ink jet recording medium used in the ink jet print system of the present invention, a form in which the information is displayed is not limited to a bar cord and may be any of designs, letters, symbols, photographs, patterns and the like. When a common logo or the like is used as said printing control information, much information cannot be incorporated. In order to incorporate a larger amount of information, code information is preferably used. The cord information is not particularly limited, and dot cords, bar cords, two-dimensional bar cords and the like can be used as the cord information.

As the substrate of the ink jet recording medium used in the present invention, a substrate composed mainly of cellulose pulp is preferable. The substrate composed mainly of cellulose pulp is base paper produced by using wood pulp such as chemical pulp such as LBKP, NBKP or the like, mechanical pulp such as GP, PGW, RMP, TMP, CTMP, CMP, CGP or the like, waste paper pulp (e.g. DIP), or non-wood pulp such as kenaf, bagasse, cotton or the like as the main component; mixing the main component with one or more of various conventional additives such as pigments, binders, sizing agents, fixing agents, yield improvers, cationizing agents, strength agents, toning dyes and the like; and making the resulting mixture into paper with any of various apparatuses such as a Fourdrinier machine, cylinder paper machine, twin-wire paper machine and the like. In the above production process of the base paper, sizing press using a water-soluble polymer may be carried out with a sizing press apparatus or the like. However, a surface-sizing agent is not incorporated into a sizing press liquid. The reason is that if the sizing press liquid contains the surface-sizing agent, the surface-sizing agent is given to both sides of the base paper, so that the high-speed absorptiveness for ink in the case of a high-speed printer is deteriorated. An ink-receiving layer(s) may be formed on such base paper in an untreated state, or a calendering apparatus such as a machine calender, TG calender, soft calender or the like may be used in order to control flattening.

The thickness of the substrate used in the present invention is preferably adjusted to 100 μm or more in view of conveyability at the time of high-speed printing with the ink jet printer apparatus. It is preferable to adjust the thickness of the ink jet recording medium to 120 μm or more by forming an ink-receiving layer(s) on one side of the substrate and printing the printing control information on the other side. When the ink jet recording medium is too thin, its conveyablility in the ink jet printer apparatus is low. Although there is no particular upper limit of the thickness of the ink jet recording medium, a thickness of more than 500 μm is undesirable in some cases because such a thickness results in a high rigidity, a very low conveyability in the ink jet recording apparatus and difficult control of printing.

As the ink jet recording medium used in the present invention, a generally used recording medium such as plain paper, paper for exclusive use for ink jet recording, glossy paper, a glossy film, a postcard, a back-print film, a sheet for OHP or the like can be used by previously recording an optically recognizable cord image on the reverse side of the generally used recording medium by the use of a common dye, common pigment, near-infrared dye or near-infrared absorber.

In the present invention, a surface-sizing agent may be given to one side or both sides of the substrate. As the surface-sizing agent, there are exemplified surface-sizing agents composed mainly of a styrene-acrylic acid copolymer, a styrene-methacrylic acid copolymer, an acrylonitrile-vinyl formal-acrylic ester copolymer, a styrene-meleic acid copolymer, an olefin-meleic acid copolymer or an alkylketene dimmer (AKD). The main component is preferably a styrene-acrylic acid copolymer, a styrene-methacrylic acid copolymer or a styrene-meleic acid copolymer. The above-exemplified copolymers or dimer can be used singly or in admixture with any of starch derivatives such as oxidized starch, etherified starch, phosphoric-esterified starch and the like; cellulose derivatives such as carboxymethyl cellulose, hydroxyethyl cellulose and the like; and water-soluble polymers such as casein, gelatin, soybean protein, poly(vinyl alcohol)s, poly (vinylpyrrolidone)s, maleic anhydride resins and the like.

In the present invention, as an apparatus for applying a coating solution containing the surface-sizing agent, there are exemplified various apparatuses such as various blade coaters, roll coaters, air-knife coaters, bar coaters, rod blade coaters, curtain coaters, short-dwell coaters and the like.

In the present invention, the coating amount of the surface-sizing agent ranges from 0.05 $g/m^2$ to 5.0 $g/m^2$ in terms of dry solids. It is preferably 0.1 $g/m^2$ to 0.3 $g/m^2$. When the coating amount of the surface-sizing agent is below the above range, a pattern is liable to be deteriorated depending on the speed of printing, during printing of the printing control information. When the coating amount of the surface-sizing agent is above the above range, the absorptiveness for printing ink is deteriorated during printing of the printing control information, so that a problem such as ink transfer is caused.

As the substrate used in the present invention, a substrate having a weight of 100 to 300 $g/m^2$ is usually used. If necessary, one side or both sides of the substrate may be coated with a resin. A polyolefin resin used for coating the substrate can be selected from polyethylenes, homopolymers of an α-olefin (e.g. propylene), copolymers of two or more of such olefins, and mixtures of two or more of these various polymers. Especially preferable examples of the polyolefin resin are low-density polyethylenes, high-density polyethylenes and mixtures thereof. Although the molecular weight of the polyolefin resin is not particularly limited, a polyolefin resin having a molecular weight in the range of 20,000 to 200,000 is usually used. In general, each coating layer is formed on the substrate in a weight of 10 to 40 g/m$^2$.

It has already been known that a white pigment, a color pigment, a fluorescent brightener and an antioxidant are added to a polyolefin resin used in a resin coating layer. That is, also in the present invention, these additives may be incorporated into the polyolefin resin coating layer on the right side of the substrate which is formed on the ink-receiving layer.

The ink-receiving layer(s) in the present invention is a porous coat containing a pigment(s) and a binder.

In the present invention, as the pigment(s) used in the ink-receiving layer(s), one or more well-known white pigments can be used. There can be used, for example, white inorganic pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, lithopone, zeolite, hydrated halloysite, magnesium carbonate, magnesium hydroxide, etc.; and organic pigments such as styrene plastic pigments, acrylic plastic pigments, polyethylenes, microcapsules, urea resins, melamine resins, etc. Of the pigments exemplified above, porous inorganic pigments such as porous synthetic amorphous silica, porous magnesium carbonate, porous alumina and the like are preferable. Porous synthetic amorphous silica having a large capacity of pore is especially preferable.

The binder used in the ink-receiving layer(s) in the present invention includes, for example, starch derivatives such as oxidized starch, etherified starch, phosphoric-esterified starch, etc.; cellulose derivatives such as carboxymethyl cellulose, hydroxyethyl cellulose, etc.; casein, gelatin, soybean protein, poly(vinyl alcohol)s, poly(vinylpyrrolidone)s, maleic anhydride resins, latices of conjugated diene type copolymers (e.g. styrene-butadiene copolymers and methyl methacrylate-butadiene copolymers); latices of acrylic polymers such as polymers or copolymers of acrylic esters and methacrylic esters; latices of vinyl copolymers such as ethylene-vinyl acetate copolymers; latices of functional group-modified polymers obtained by modifying any of the above various polymers by the use of a monomer containing the functional group such as carboxyl group; aqueous binders of, for example, thermosetting synthetic resins such as melamine resins and urea resins; latices of polymer or copolymer resins of acrylic or methacrylic esters such as poly(methyl methacrylate)s; polyurethane resins, unsaturated polyester resins, vinyl chloride-vinyl acetate copolymers, poly(vinyl butyral) s, and alkyd resin latices.

In addition, when the ink jet recording medium is used in an ink jet recording method using also dye ink, the ink-receiving layer(s) preferably contains a cationic compound(s) besides the components described above. Furthermore, the ink-receiving layer(s) may properly contain other additives such as pigment dispersants, thickening agents, fluidity improvers, surfactants, defoaming agents, foam-inhibitors, mold release agents, foaming agents, penetrating agents, color dyes, color pigments, fluorescent brighteners, ultraviolet absorbers, antioxidants, antiseptics, mildew-proofing agents, water-proofing agents, wet strength agents, dry strength agents, etc.

The cationic compound(s) used in the present invention is a so-called dye-fixing agent containing a secondary or tertiary amine or a quaternary ammonium salt, which forms an insoluble salt with the sulfonic acid group, carboxyl group, amino group or the like of a water-soluble direct dye or water-soluble acid dye contained in water-color dye ink. As the cationic compound(s), either a single compound or a combination of two or more compounds may be used. The cationic compound(s) may be properly added to the ink-receiving layer adjacent to the substrate.

In the present invention, the total number and structure of the ink-receiving layer(s) formed on the substrate are not particularly limited. That is, two or more layers can be formed on one side of the substrate as the ink-receiving layers.

The coating amount of the ink-receiving layer(s) is preferably determined on the basis of the volume of ink absorbed by the ink-receiving layer(s) and bond strength between the ink-receiving layer(s) and the substrate which is sufficient in practice. The dry coating amount of the ink-receiving layer(s) ranges preferably from 5 to 40 g/m$^2$. When the dry coating amount is less than 5 g/m$^2$, it is difficult for the ink-receiving layer(s) to cover the substrate surface completely, so that the absorptiveness for ink is insufficient. Therefore, the non-uniformity of the absorption and the like are caused, resulting in an undesirable influence on the ink jet printing capability. On the other hand, when the dry coating amount is more than 40 g/m$^2$, the bond strength between the ink-receiving layer(s) and the substrate becomes insufficient in practice, so that there is undesirably caused, for example, peeling of the coating layer(s) from the substrate which is called "powder exfoliation".

In the present invention, as an apparatus for coating or impregnation with a coating composition for forming the ink-receiving layer(s), various apparatuses such as various blade coaters, roll coaters, air-knife coaters, bar coaters, rod blade coaters, curtain coaters, short-dwell coaters and the like can be used in on-machine or off-machine coating.

As to a process for producing an ink jet recording sheet in the present invention, the ink-receiving layer(s) is formed on the substrate and the substrate having the ink-receiving layer(s) formed thereon may be used as it is as the ink jet recording sheet without surface treatment, or may be subjected to after-treatment comprising control of its surface roughness with any of various calenders. Specific examples of the aforesaid calendars are an embossing calender, machine calender, TG calender, supercalender, soft calender and the like. The aforesaid calendars are not limited thereto and may be properly selected depending on a material related to the surface structure of the sheet.

In the present invention, although the printing control information is preferably provided on the surface of the substrate which is reverse to the ink-receiving layer(s) side, it may be printed on the surface of substrate under the ink-receiving layer(s) so long as the printing control information is made readable with the information-detecting sensor by controlling the transparency of the ink-receiving layer(s). In addition, a resin coating layer is preferably formed on the printing control information after printing the printing control information on the substrate because the surface of the ink jet recording medium is worn away in some cases during the travel of the recording medium in the apparatuses in the ink jet recording system, so that wrong operation is liable to be caused in the information-detecting sensor. The printing control information in the present invention can be printed by a well-known technique. For example, a gravure printing method, offset printing method, thermal transfer method, ink jet method, silk screen printing method, letterpress printing method, electrophotographic method, intaglio printing method and the like can be adopted.

As the common dye and common pigment used in printing ink for the printing control information in the present invention, well-known dyes and pigments can be used.

As the near-infrared dye and near-infrared absorber used in this printing ink, there can be used well-known near-infrared dyes and near-infrared absorbers, which have a function of selectively absorbing near infrared rays (infrared rays having a wavelength of approximately 800 nm to 2500 nm), i.e., infrared rays in a region near the visible region and have recently been used in an optical character recognition apparatus (OCR), the sensitization portion of an electrophotographic printer, or a coating film for optical disk. There can be exemplified aluminum salts such as NIR-AM1, NIR-AM3 and NIR-AM4 (mfd. by Nagase Chemtex Co., Ltd.), aluminum compounds such as IRG-002 and IRG-003 and diimonium compounds such as IRG-022 and IRG-023 (mfd. by Nippon Kayaku Co., Ltd.).

In the present invention, a dye capable of absorbing light in a wavelength range of 750 to 1100 nm is used. Although not limited, suitable examples of the dye are oxonol, squarylium, chalcogenopyrylarylidene, bis(chalcogenopyrylo)polymethine, bis(aminoaryl)polymethine, merocyanine, trinuclear cyanine, indene-crosslinked polymethine, oxyindolidine, iron complexes, quinoids, nickel-dithiolene complex, and cyanine dyes (carbocyanine, azacarbocyanine, hemicyanine, styryl, diazacarbocyanine, triazacarbocyanine, diazahemicyanine, polymethinecyanine, azapolymethinecyanine, Holopolar, indocyanine and diazahemicyanine dyes). The role of the near-infrared dye is to convert near-infrared ray electromagnetic waves to heat, and any near-infrared dye well known in the art may be used.

The ink for printing in the present invention contains the near-infrared dye and the near-infrared absorber, and as the dye and the absorber, a dye and/or an absorber can be used which have a sensitivity satisfying the demand of the information-detecting sensor. The concentration of the dye in the ink may be low because the print density of the ink jet recording medium may be such that the printing control information can be recognized, as described above.

In the present invention, in order to make possible the visual observation of a pattern on the reverse side, the following can be used in the printing ink used in the present invention: coloring components such as black pigments (e.g. carbon black), white pigments (e.g. titanium oxide), blue pigments (e.g. copper phthalocyanine), and pigments and/or dyes, which can give a hue satisfying the demand of a user. The concentration of the pigment in the ink may be low because the coloring density of a printed image on the ink jet recording medium may be such that the printed image can be recognized.

As a resin incorporated into the ink, cellulose derivatives, shellac resins and the like are usually used. The amount of this resin added may also be small as in the case of the pigment when the print density is low.

Although said ink jet recording medium may be in the form of sheets, a roll obtained by winding rolled paper around a core is preferable from the viewpoint of conveyance and the efficiency of paper feed. It is preferable that a means for making printing impossible in said ink jet recording apparatus stops the conveying and driving apparatus. The means for making printing impossible in said ink jet recording apparatus preferably prevents interlocking of the conveying and driving apparatus with image formation using ink jet nozzles. The means for making printing impossible in said ink jet recording apparatus preferably stops the discharge of ink. The means for making printing impossible in said ink jet recording apparatus preferably changes the amount of ink discharged, to form an image different from a desired image.

The previously recognizable image on the reverse side of said ink jet recording medium is preferably recognizable by means of visible light or near infrared rays. The previously recognizable image on the reverse side of said ink jet recording medium is preferably an image that emits fluorescence. The previously recognizable image on the reverse side of said ink jet recording medium is preferably a cord image. A logo print is better than the cord image because of its easier recognition but holds a smaller amount of information than does the cord image. Particularly when the amount of information is small, the employment of the logo print is more effective. When the amount of information is large, the cord image is preferably used. When the ink jet recording medium is a rolled paper, it is more preferable to cut the recording medium subjected to normal printing, to a proper length instead of winding up this recording medium.

EXAMPLES 1 TO 6

The present invention is explained below in detail with reference to specific examples.

As ink jet recording media to be evaluated, ink jet recording medium A is a plain-paper type medium having no coating layer (150 g/m$^2$, 160 μm), ink jet recording medium B is paper for exclusive use for ink jet recording which has a coating layer (160 g/m$^2$, 165 μm) and ink jet recording medium C is resin-coated paper (220 g/m$^2$, 225 μm). Each of these ink jet recording media is genuine exclusive paper recommended by a maker. Therefore, genuine ink jet recording ink recommended by the maker is used which gives the optimum printed image.

Ink jet recording media D and E are ink jet recording papers having a coating layer but are not recommended by the maker. As these recording media, imitations called pirated versions which are similar to ink jet recording medium B are used by obtaining them in the market. These imitations are defective products which have already been returned owing to users' claim from a store specializing in ink jet print because of serious ink overflow and banding.

Using the five kinds of the ink jet recording media described above, rolled papers are prepared by winding each recording medium around a core (76 mmϕ×150 mm (width)) to a width of 150 mm and a length of 1000 mm.

A logo and a cord image are printed on the reverse side of each of ink jet recording media A to C and E with a gravure printing machine by preparing the ink described hereinafter. Ink jet recording medium D is used as it is without printing thereon printing control information. In addition, printing control information adjusted so as to give the optimum printed image is printed on each of ink jet recording media A to C by the use of the genuine ink jet recording ink recommended by the maker. However, on ink jet recording medium E, the same printing control information as in the case of ink jet recording medium B is printed except for peculiar cord information indicating a genuine product.

Ink jet recording medium C is produced as follows. The right surface of a paper substrate is subjected to melt extrusion coating with titanium oxide in an amount of 10% by weight and a low-density polyethylene in an amount of 90% by weight. In addition, the reverse side of the paper substrate is subjected to gravure printing. Then, the thus treated paper substrate is coated with a resin by a melt extrusion coating method. On the resulting resin-coated paper, an ink-receiving layer comprising amorphous silica is formed to produce the ink jet recording medium.

[Ink for Printing a Logo]

Ink for printing control information is prepared by the use of coloring components such as a black pigment (e.g. carbon black), a white pigment (e.g. titanium oxide) or a blue pigment (e.g. copper phthalocyanine), and a pigment and/or dye, which can give a hue satisfying the demand of a user. As a resin incorporated into the ink, a cellulose derivative, a shellac resin or the like is used. As to the coloring density of a printed image on the ink jet recording medium, the pigment concentration and resin concentration in the ink are adjusted so that the information-detecting sensor can recognize the printed image.

[Ink for Printing a Cord Image]

Ink for printing a cord image is prepared in the same manner as in the case of the aforesaid printing ink, except for mixing a far-infrared dye or a fluorescent brightener with the above-mentioned resin and omitting the coloring components such as pigments and dyes.

Ink jet recording medium D is used as it is as an ink jet recording medium having no printing control information printed thereon. Each of ink jet recording media A to C and E having the printing control information printed thereon is accommodated in a cartridge in the form of a rolled paper.

As the printing control information, a logo is printed on ink jet recording medium A, a cord image is printed on ink jet recording medium B by the use of the far-infrared dye, and a cord image is printed on ink jet recording medium C by the use of the fluorescent brightener.

The printing control information printed as the logo or the cord image is information that permits recognition of each of the above-mentioned ink jet recording media A to C as a genuine product, and permits the optimum matching of ink jet recording ink with the recording medium to give a printed image in the optimum state.

In addition, although ink jet recording medium E is an imitation, the same cord image as in the case of ink jet recording medium B, a genuine product is printed on ink jet recording medium E. As described above, ink jet recording medium E is an article which can give only an inferior printed image and against which a user has made a claim. Ink jet recording medium E has the printing control information printed thereon though it does not well match with this information as an ink jet recording medium.

FIG. 1 is a block diagram showing the whole structure of a print system according to an embodiment of the present invention. A processing-for-printing apparatus 2 controls a conveying apparatus 3 and an ink jet recording apparatus 4 on the basis of print information sent from an image processor 1 and the printing control information c of an ink jet recording medium 6 sent from an information-detecting sensor 5, and prints an image on the ink jet recording medium 6.

EXAMPLE 1

A cartridge charged with each of ink jet recording media A to E as the ink jet recording medium 6 is set in a feeder, and the conveying apparatus 3 and the ink jet recording apparatus 4 are controlled on the basis of the printing control information and the print information sent from the image processor 1 without using the information detecting sensor 5 and internal database information stored in the processing-for-printing apparatus 2, whereby an image is printed on the ink jet recording medium 6.

As genuine products, ink jet recording media A to C treated as above and composed of an ink jet recording medium and ink jet recording ink is controlled on the basis of the printing control information, and each of them can exhibit its optimum performance in the formation of a printed image. However, although ink jet recording medium E, an imitation has the printing control information, it cannot exhibit its optimum performance because the printing control information does not match with this recording medium, so that ink jet printing is not conducted under the optimum conditions. Needless to say, no satisfactory image can be obtained, resulting in somewhat remarkable ink overflow and banding. In addition, in the case of ink jet recording medium D having no printing control information, serious ink flow and banding are caused, and, for example, the roll in the conveying apparatus is stained with undried ink jet recording ink. Therefore, the ink jet recording medium becomes useless in practice and moreover, cleaning in the conveying apparatus becomes necessary, resulting in a troublesome work. This cleaning requires a very long time, so that the ink jet print system is stopped for a long period of time until starting of the system, resulting in a remarkably lowered working efficiency.

EXAMPLE 2

Using the information-detecting sensor 5, the following control conditions (1) and (2) are continuously imposed on the system so that each of them may affect 500 m of the ink jet recording medium 6 when no printing control information is present. Each of ink jet recording media A to E is charged into a cartridge as the ink jet recording medium 6 and set in a feeder, and a command to start printing of an image is given to each of ink jet recording media A to E.

(1) The discharge of ink from the nozzles of the ink jet recording apparatus is stopped.

(2) The conveying and driving apparatus is stopped.

As a genuine product, each of ink jet recording media A to C gives a desired printed image without the stop of the discharge of ink from the nozzles of the ink jet recording apparatus and the stop of the conveying and driving apparatus.

However, in the case of ink jet recording media D and E, imitations, about 500 m of each recording medium is conveyed in an unprinted state and then the conveying and driving apparatus stops, so that printing becomes impossible. The reason is as follows: ink jet recording medium D has no printing control information, and ink jet recording medium E has the printing control information printed thereon but has no peculiar cord information indicating a genuine product, so that it is recognized as an imitation.

EXAMPLE 3

When no printing control information is present, the following control conditions (1) to (4) are continuously imposed on the system so that each of them may affect about 250 m of the ink jet recording medium 6 and that the ink jet recording apparatus and the conveying and driving apparatus may not be interlocked with each other. Each of ink jet recording media A to E is charged into a cartridge as the ink jet recording medium 6 and set in a feeder, and an attempt is made to print an image on each of ink jet recording media A to E.

(1) The amount of ink discharged in the ink jet recording apparatus is controlled at 25% of the optimum amount.

(2) The amount of ink discharged in the ink jet recording apparatus is controlled at 150% of the optimum amount.

(3) The conveying speed of the conveying and driving apparatus is controlled at a low speed of 0.5 time the optimum speed.

(4) The conveying speed of the conveying and driving apparatus is controlled at a high speed of 1.5 times the optimum speed.

Ink jet recording media A to C, genuine products having the printing control information can give a desired image without the variation of the amount of ink discharged in the ink jet recording apparatus and the conveying speed of the conveying and driving apparatus.

However, under the control conditions (1) and (4), both ink jet recording media D and E give a wholly light image because of a low coloring density, resulting in loss of the commercial value. Under the control condition (4), the coloring density is low and moreover, an image stretched in a conveying direction different from that based on image data is outputted. The reason for these facts is as follows: ink jet recording medium D has no printing control information, and ink jet recording medium E has the printing control information printed thereon but has no peculiar cord information indicating a genuine product, so that it is recognized as an imitation.

Under the control conditions (2) and (3), ink overflow is caused in the case of ink jet recording medium E, an imitation, and very serious ink overflow and banding are caused in the case of ink jet recording medium D, an imitation, so that, for example, the roll in the conveying apparatus is stained with undried ink jet recording ink. With respect also to the ink jet print system, the ink jet recording medium is stained to lose its utility, and moreover, the maintenance such as cleaning of the roll of the conveying and drying apparatus in the system becomes necessary, resulting in insufficient working efficiency and economical benefit. Under the control condition (3), the coloring density is low and moreover, an image shrunk in a conveying direction different from that based on image data is outputted.

EXAMPLE 4

The following control conditions (1) and (2) are continuously imposed on the system so that each of them may affect 500 m of the ink jet recording medium 6, after the comparison of the printing control information obtained from the information-detecting sensor 5 with the internal database information stored in the processing-for-printing apparatus 2.

(1) The discharge of ink from the nozzles of the ink jet recording apparatus is stopped.

(2) The conveying and driving apparatus is stopped.

Each of the following ink jet recording media is charged into a cartridge as the ink jet recording medium 6 and set in a feeder, and a command to start printing of an image is given thereto: ink jet recording medium A having the logo printing control information, ink jet recording medium B having the printing control information given by the use of the far-infrared dye, ink jet recording medium C having the printing control information given by the use of the fluorescent brightener, ink jet recording medium D having no printing control information printed thereon, and ink jet recording medium E having the printing control information printed thereon which does not well match with the ink jet recording medium.

In the case of ink jet recording media A to C, genuine products, the printing control information agrees with the database information, so that each of these recording media can be made into an ink jet recording medium having the best image, without the stop of the discharge of ink from the nozzles of the ink jet recording apparatus and the stop of the conveying and driving apparatus. However, in the case of ink jet recording medium D having no printing control information printed thereon (an imitation) and ink jet recording medium E having the printing control information printed thereon which does not well match with the recording medium itself, about 500 m of each recording medium continues to be in an unprinted state and the conveying and driving apparatus stops.

EXAMPLE 5

When the printing control information obtained from the information-detecting sensor 5 is compared with the internal database information stored in the processing-for-printing apparatus 2 and is found to be not in agreement therewith, the following control conditions (1) to (4) are continuously imposed on the system so that each of them may affect about 250 m of the ink jet recording medium 6 and that the ink jet recording apparatus and the conveying and driving apparatus may not be interlocked with each other. Each of ink jet recording media A to E is charged into a cartridge as the ink jet recording medium 6 and set in a feeder, and a command to start printing of an image is given to each of ink jet recording media A to E.

(1) The amount of ink discharged in the ink jet recording apparatus is controlled at 25% of the optimum amount.

(2) The amount of ink discharged in the ink jet recording apparatus is controlled at 150% of the optimum amount.

(3) The conveying speed of the conveying and driving apparatus is controlled at a low speed of 0.5 time the optimum speed.

(4) The conveying speed of the conveying and driving apparatus is controlled at a high speed of 1.5 times the optimum speed.

In the case of ink jet recording media A to C, genuine products, the printing control information agrees with the database information, so that each of these recording media can give the best printed image without the variation of the amount of ink discharged in the ink jet recording apparatus and the conveying speed of the conveying and driving apparatus.

However, in the case of the imitations, i.e., ink jet recording medium D having no printing control information and ink jet recording medium E having the printing control information printed thereon which does not well match with the recording medium itself, they give a wholly light image because of a low coloring density, resulting in loss of the commercial value, under the control conditions (1) and (4). Under the control condition (4), the coloring density is low and moreover, an image stretched in a conveying direction different from that based on image data is outputted.

Under the control conditions (2) and (3), ink overflow is caused in the case of ink jet recording medium E, an imitation, and very serious ink overflow and banding are caused in the case of ink jet recording medium D, an imitation, so that, for example, the roll in the conveying apparatus is stained with undried ink jet recording ink. With respect also to the ink jet print system, the ink jet recording medium is stained to lose its utility, and moreover, the maintenance such as cleaning of the roll of the conveying apparatus in the system becomes necessary, resulting in insufficient economical benefit. Under the control condition (3), the coloring density is low and moreover, an image shrunk in a conveying direction different from that based on image data is outputted.

EXAMPLE 6

The following control conditions (1) to (3) are continuously imposed on the system so that each of them may affect 300 m of the ink jet recording medium 6, when the printing control information obtained from the information-detecting sensor 5 is compared with the internal database information stored in the processing-for-printing apparatus 2 and is found to be not in agreement therewith.

(1) The conveying apparatus is kept driven and the discharge of ink from the nozzles of the ink jet recording apparatus is stopped, followed by cutting to a predetermined length with the cutter apparatus. In addition, the resulting sheets are separated with the tray apparatus.

(2) The conveying apparatus is kept driven and the discharge of ink from the nozzles of the ink jet recording apparatus is stopped, followed by recovery in a roundabout way with the roll-recovering apparatus instead of use of the cutter apparatus.

(3) The conveying and driving apparatus is stopped.

Each of the following ink jet recording media is charged into a cartridge as the ink jet recording medium 6 and set in a feeder, and a command to start printing of an image is given thereto: ink jet recording medium A having the logo printing control information, ink jet recording medium B having the printing control information given by the use of the far-infrared dye, and ink jet recording medium C having the printing control information given by the use of the fluorescent brightener, which are genuine products; and ink jet recording medium D having no printing control information and ink jet recording medium E having the printing control information printed thereon which does not well match with the ink jet recording medium itself, which are imitations.

In the case of ink jet recording media A to C, genuine products, the printing control information agrees with the database information, and each of these recording media is cut to a predetermined length to give a print having the best printed image, without the stop of the discharge of ink and the stop of the conveying and driving apparatus.

However, in the case of ink jet recording medium D having no printing control information (an imitation) and ink jet recording medium E having the printing control information printed thereon which does not well match with the ink jet recording medium, about 300 m of unprinted recording medium is cut to a predetermined length by the cutter apparatus, about 300 m of unprinted recording medium is recovered by the roll-recovering apparatus, and the conveying and driving apparatus stops at a total length of about 600 m.

EXAMPLES 7 TO 15 AND COMPARATIVE EXAMPLE 1

The present invention is explained below in further detail.

Examples of the present invention are explained below but they are not intended in any way to limit the scope of the invention.

A substrate used in the examples is produced as follows. A mixture consisting of 80% by weight of hardwood kraft pulp and 20% by weight of hardwood sulfite pulp as natural pulps is beaten to 280 ml in terms of Canadian standard freeness (JIS P-8121) to prepare a pulp slurry. To the pulp slurry are added as strength agents an amphoteric polyacrylamide with a molecular weight of 800,000 in an amount of 1.0% by weight based on the weight of the pulps, an alkylketene dimer in an amount of 0.01 to 0.8% by weight based on the weight of the pulps, and a polyamide•polyamine•epichlorohydrin resin in an amount of 1.0% by weight based on the weight of the pulps. The resulting mixture is diluted with water so as to give a 1% slurry. This slurry is made into paper having a basis weight of 120 g/m$^2$, with a Fourdrinier machine, and a 2.0% by weight aqueous polyvinyl alcohol solution is applied on the paper with a size press to obtain a substrate for ink jet recording medium. In addition, this substrate is calendered.

EXAMPLE 7

The components for preparing printing ink are prepared so as to have the following compositions. The percentages described below are by weight in terms of solids. In the case of printing control information distinguishable by means of visible light, the printing control information is provided on the surface of the substrate by gravure printing by using a liquid consisting of the following ink and diluent in a weight ratio of 1:4:ink containing 1.0% by weight of carbon black as a pigment, 5.0% by weight of nitrocellulose as a resin, 50.0% by weight of ethanol as a solvent for the resin, 27.0% by weight of isopropanol and 17.0% by weight of ethyl acetate; and a mixed organic solvent used as a diluent for the ink and composed of three constituents, i.e., an alcohol, an acetic acid ester and a glycol ether.

As to the gravure printing, the logo pattern of a gravure roll having a cell depth of 20 μm is printed with a gravure printing machine.

An ink-receiving layer is formed by applying a coating solution having the following composition, on the substrate surface reverse to the surface on which the printing control information has been provided, with an air-knife coater so that the dry coating amount may be 15 g/m$^2$, and drying the coating solution. Thus, an ink jet recording medium of Example 7 is produced.

(Coating Solution for the Ink-Receiving Layer)

| | |
|---|---|
| Pseudo-boehmite powder | 15 parts |
| Polyvinyl alcohol | 2 parts |
| Water | 100 parts |

EXAMPLE 8

Printing control information is provided in the same manner as in Example 7. In addition, after a drying step, the printing side is subjected to corona discharge treatment, and then coated with a mixture consisting of 50% by weight of a high-density polyethylene and 50% by weight of a low-density polyethylene, by melt extrusion coating so that the coating amount may be 20 g/m$^2$. Then, in the same manner as in Example 7, an ink-receiving layer is formed on the substrate surface reverse to the surface on which the printing control information has been provided, to produce an ink jet recording medium of Example 8.

EXAMPLE 9

Printing control information is provided in the same manner as in Example 7. In addition, after a drying step, a polypropylene film of 20 μm in thickness is attached to the printing side with an adhesive. Then, in the same manner as in Example 7, an ink-receiving layer is formed on the substrate surface reverse to the surface on which the printing control information has been provided, to produce an ink jet recording medium of Example 9.

EXAMPLE 10

An ink jet recording medium of Example 10 is produced in the same manner as in Example 8 except for carrying out gravure printing of a cord image on the surface of the substrate.

EXAMPLE 11

An ink jet recording medium of Example 11 is produced in the same manner as in Example 8 except for carrying out gravure printing of a dot image on the surface of the substrate.

EXAMPLE 12

An ink jet recording medium of Example 12 is produced in the same manner as in Example 9 except for carrying out gravure printing of a cord image on the surface of the substrate.

EXAMPLE 13

An ink jet recording medium of Example 13 is produced in the same manner as in Example 9 except for carrying out gravure printing of a dot image on the surface of the substrate.

EXAMPLE 14

An ink jet recording medium of Example 14 is produced in the same manner as in Example 10 except for using a fluorescent dye in an amount of 0.5% by weight in place of carbon black used as a pigment in an amount of 1.0% by weight in the component for preparing the printing ink, in order to facilitate confirmation by exposure to ultraviolet light.

EXAMPLE 15

An ink jet recording medium of Example 15 is produced in the same manner as in Example 10 except for using a nickel complex type dye, a near-infrared dye, in an amount of 0.1% by weight in place of carbon black used as a pigment in an amount of 1.0% by weight in the component for preparing the printing ink.

COMPARATIVE EXAMPLE 1

An ink jet recording medium of Comparative Example 1 is produced in the same manner as in Example 7 except for providing no printing control information.

(Adjustment of the Ink Jet Recording Apparatus)

An information-detecting sensor capable of reading printing control information is located short of the ink nozzles, and database information regarding output information and the printing control information is incorporated into the ink jet recording apparatus. The printing control information is a pattern formed by each of logo printing, bar cord image printing and dot image printing, and is designed to be detectable with the information-detecting sensor and to be reflected in the ink jet recording apparatus. The printing control information is designed to be incorporated with the following five control commands.

(Printing-Control Commands)

(1) When no printing control information is present, the whole ink jet recording apparatus stops.

(2) When the database information and the printing control information do not agree with each other, the discharge of ink from the ink nozzles of the ink jet recording apparatus stops and the conveying apparatus also stops.

(3) When the database information and the printing control information do not agree with each other, the discharge of ink from the ink nozzles of the ink jet recording apparatus stops, but the conveying apparatus keeps working to discharge an ink jet recording medium in an unprinted state from the ink jet recording apparatus.

(4) When the database information and the printing control information do not agree with each other, the driving speed of the driving apparatus is kept at the optimum speed and the amount of ink discharged from the ink nozzles of the ink jet recording apparatus is made 20% smaller than the optimum amount.

(5) When the database information and the printing control information do not agree with each other, the driving speed of the driving apparatus is made 20% higher than the optimum speed and the amount of ink discharged from the ink nozzles of the ink jet recording apparatus is kept at the optimum amount.

Using the above-mentioned ink jet recording media of Examples 7 to 15 and ink jet recording medium of Comparative Example 1, a printing test was carried out with the ink jet recording apparatus under each of the conditions described above as the printing-control commands 1 to 5.

All of the ink jet recording media of Examples 7 to 15 corresponding to genuine products have no particular defect and can give an image by exhibition of the optimum performance of each ink jet recording medium. However, with the ink jet recording medium of Comparative Example 1 corresponding to an imitation, but not the product of the present invention, the whole ink jet recording apparatus stops in the case of the printing-control command (1). In addition, in the case of the printing-control command (2), the discharge of ink from the ink nozzles stops and the conveying apparatus also stops, and hence printing is impossible. In the case of the printing-control command (3), the discharge of ink from the ink nozzles stops but the conveying apparatus works, and hence unprinted ink jet recording medium having no image is discharged. Moreover, in the case of the printing-control command (4), no optimum image can be obtained and only an image having a low density as a whole can be obtained. Furthermore, in the case of the printing-control command (5), ink jet recording medium of no practical use is obtained which has a changed image with a low density.

INDUSTRIAL APPLICABILITY

The embodiments described above are examples for explaining the present invention, but they are not intended in any way to limit the scope of the invention and various changes and modifications may be made without departing from the gist of the invention. For example, as the image processor, a common personal computer may be utilized which is not provided in an ink jet printer or is a small-scale system.

The invention claimed is:

1. An ink jet print system in which an ink jet recording medium previously having printing control information is continuously driven with a conveying apparatus, and print data is continuously processed with an ink jet recording apparatus set in the middle of a conveyance pathway, to output a printed image, wherein the printing control information involves information of various kinds about the kind of ink most suitable for the ink jet recording medium, the kind of a substrate and the kind of an ink-receiving layer(s), and at least one item of information for controlling a conveying and driving apparatus, an ink jet recording apparatus, and a discharging apparatus for ink nozzles in the recording apparatus, a cutter apparatus, a tray apparatus and the like, which information is for controlling a series of the apparatuses of the ink jet print system on the basis of the above-mentioned information of various kinds.

2. An ink jet print system according to claim 1, wherein an information-detecting sensor is located short of said ink jet recording apparatus in the conveyance pathway, and the driving apparatus stops when the printing control information is not detected in said ink jet recording medium.

3. An ink jet print system according to claim 1, wherein an information-detecting sensor is located short of said ink jet recording apparatus in the conveyance pathway, and an image different from that based on image data is output so as not to permit formation of a desired image, without interlocking said ink jet recording apparatus with the conveying apparatus, when the printing control information is not detected in said ink jet recording medium.

4. An ink jet print system according to claim 1, wherein an information-detecting sensor is located short of said ink jet recording apparatus in the conveyance pathway, and the discharge of ink in said ink jet recording apparatus is stopped to output no printed image when the printing control information is not detected in said ink jet recording medium.

5. An ink jet print system according to claim 1, wherein an information-detecting sensor is located short of said ink jet recording apparatus in the conveyance pathway; information related to the printing control information of said ink jet recording medium is stored in the system as database information and compared with the printing control information of said ink jet recording medium obtained from the information detecting sensor; and said ink jet recording medium is cut to a predetermined length with a cutter apparatus to conduct finishing when the printing control information of the ink jet recording medium agrees with the database information in the system.

6. An ink jet print system according to claim 2, wherein information related to the printing control information of said ink jet recording medium is stored in the system as database information and compared with the printing control information of said ink jet recording medium obtained from the information-detecting sensor, and the conveying and driving apparatus stops when the printing control information does not agree with the database information.

7. An ink jet print system according to claim 3, wherein information related to the printing control information of said ink jet recording medium is stored in the system as database information and compared with the printing control information of said ink jet recording medium obtained from the information-detecting sensor, and an image different from that based on image data is outputted so as not to permit formation of a desired image, without interlocking said ink jet recording apparatus with the conveying apparatus, when the printing control information does not agree with the database information.

8. An ink jet print system according to claim 4, wherein information related to the printing control information of said ink jet recording medium is stored in the system as database information and compared with the printing control information of said ink jet recording medium obtained from the information-detecting sensor, and the discharge of ink in the ink jet recording apparatus is stopped to output no printed image when the printing control information does not agree with the database information.

9. An ink jet print system according to claim 1, wherein said ink jet recording medium is a rolled paper having a core.

10. An ink jet print system according to claim 8, wherein the discharge of ink in said ink jet recording apparatus is stopped and the conveying apparatus is driven to recover the ink jet recording medium having no printed image, with a roll-recovering apparatus.

11. An ink jet print system according to claim 7, wherein the discharge of ink in said ink jet recording apparatus is stopped and the conveying apparatus is driven to recover the ink jet recording medium having an outputted image different from that based on image data, with a roll-recovering apparatus.

12. An ink jet print system according to claim 1, wherein said ink jet recording medium is separated with a roll-recovering apparatus.

13. An ink jet print system according claim 1, wherein said ink jet recording medium is cut with a cutter and then separated with the tray apparatus, instead of using a roll-recovering apparatus.

14. An ink jet print system according to claim 1, wherein said printing control information is provided on the side reverse to the side of said ink jet recording medium on which ink jet recording is to be conducted.

15. An ink jet print system according to claim 1, wherein said printing control information of said ink jet recording medium is detected with an information-detecting sensor by means of at least one light selected from visible light, near infrared rays and fluorescence.

16. An ink jet print system according to claim 1, wherein at least one of a logo print and code information is selected as said printing control information of said ink jet recording medium and is detected with an information-detecting sensor.

17. An ink jet print system according to claim 1, wherein after the impartment of said printing control information to said ink jet recording medium, the surface on which the impartment has been carried out is subjected to at least one treatment selected from coating of the surface with a resin by extrusion coating and attachment of a resin film to the surface.

18. An ink jet print system according to claim 7, wherein the amount of ink discharged from the ink nozzles of the ink jet recording apparatus is smaller than the optimum amount by 10% or more, or the speed of conveyance of the ink jet recording medium in the ink jet recording apparatus is higher than the optimum speed by 10% or more.

* * * * *